United States Patent [19]

Rouse et al.

[11] 4,204,641

[45] May 27, 1980

[54] DISPENSING NOZZLE FOR SEALING PLASTICS

[75] Inventors: John W. Rouse, Fairlawn; Archibald H. Payne, Scotch Plains, both of N.J.

[73] Assignee: American Can Company, Greenwich, Conn.

[21] Appl. No.: 878,016

[22] Filed: Feb. 15, 1978

[51] Int. Cl.[2] ..... B05B 1/28; B05B 3/02

[52] U.S. Cl. ..... 239/121; 118/317; 118/323; 239/135; 239/225

[58] Field of Search ..... 239/120, 121, 124, 126, 239/133, 135, 139, 222–225, 548, 559, 567, 214, 558, 246–249, 565, 598, 601; 113/80 B; 118/308, 312, 317, 326, 627, 323, 626

[56] References Cited

U.S. PATENT DOCUMENTS

| | | | |
|---|---|---|---|
| 1,586,997 | 6/1926 | Hull | 239/214 X |
| 1,676,113 | 7/1928 | Riley | 239/223 |
| 2,495,328 | 1/1950 | Harrison | 239/223 X |
| 2,631,948 | 3/1953 | Belitz et al. | 118/326 X |
| 2,917,241 | 12/1959 | Waldrum | 239/214 |
| 2,933,133 | 4/1960 | Vixler | 239/601 X |
| 2,964,246 | 12/1960 | Alholm et al. | 239/247 X |
| 3,081,947 | 3/1963 | Walter | 239/246 |
| 3,085,749 | 4/1963 | Schweitzer et al. | 118/626 X |
| 3,233,580 | 2/1966 | Levake | 239/223 X |
| 3,281,076 | 10/1966 | Burnside et al. | 239/223 X |
| 3,408,008 | 10/1968 | Cocks | 239/139 |
| 3,422,795 | 1/1969 | Smith | 118/317 X |
| 3,455,275 | 7/1969 | Podesta et al. | 239/223 X |
| 3,568,934 | 3/1971 | Dunn | 239/567 |
| 3,637,137 | 1/1972 | Chebuhar et al. | 239/223 |
| 3,886,565 | 5/1975 | Kojima | 239/601 X |

*Primary Examiner*—Johnny D. Cherry

*Attorney, Agent, or Firm*—Robert P. Auber; Ira S. Dorman; Stuart S. Bowie

[57] ABSTRACT

A pair of spinning nozzles for applying plastics sealant to a pair of openings in a can end such as a carbonated beverage or beer can end. The spinning nozzle has an annular opening, a circle of round openings, or a circle of small surgical steel pipes sized to be on the order of a hypodermic needle for delivering the adhesive in an upward direction against the bottom of an overlying can end. A shroud is provided to confine excessive adhesive, and a screen or field of vacuum-applying holes are positioned within the shroud and around the nozzles to suck excess adhesive back into a reservoir. A heater is used to keep the plastics soft and flowing.

3 Claims, 6 Drawing Figures

FIG. 2
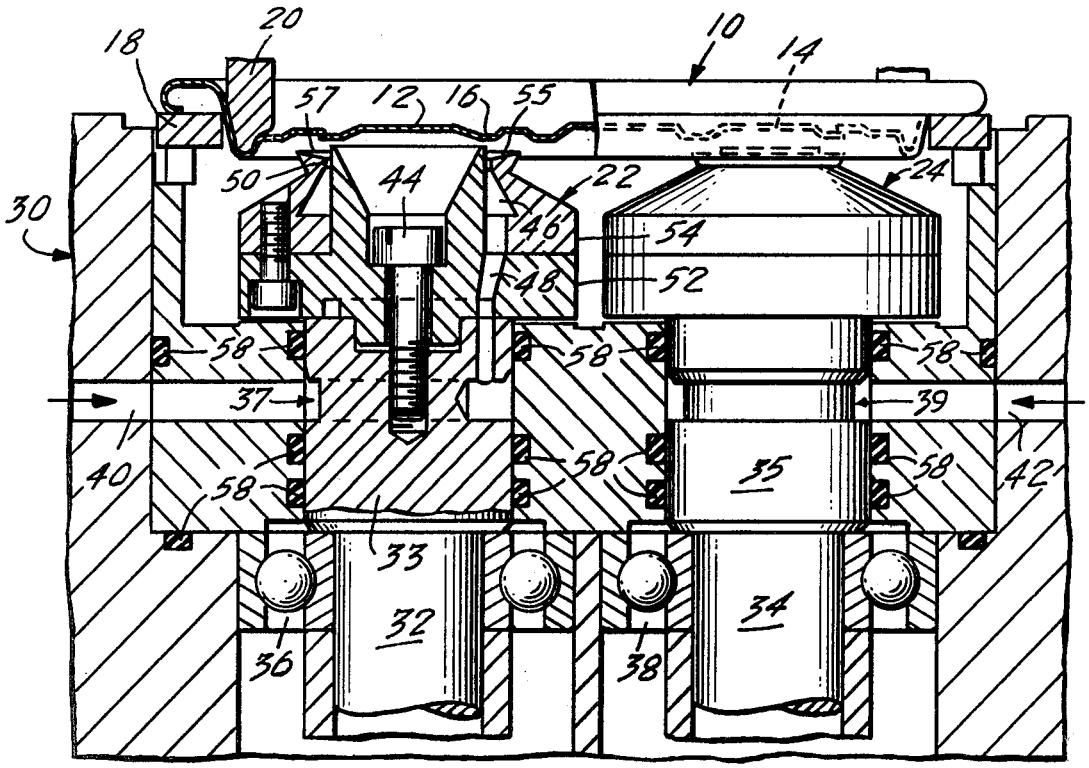
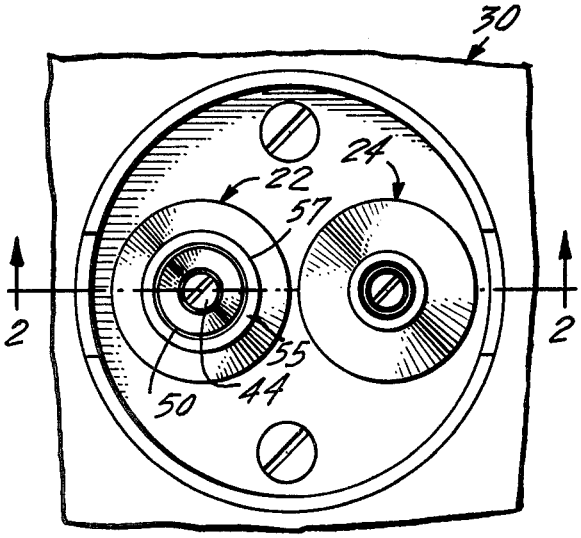
FIG. 1
FIG. 3
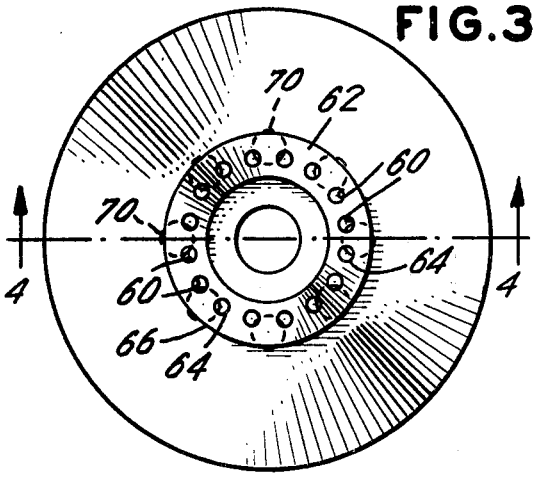
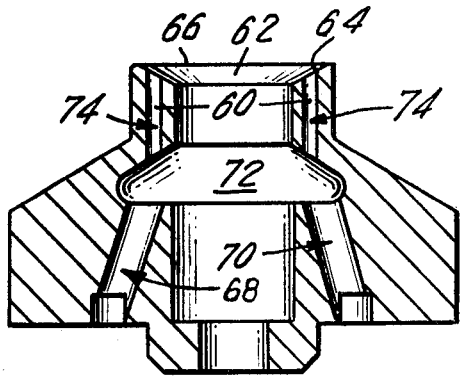
FIG. 4

FIG. 6
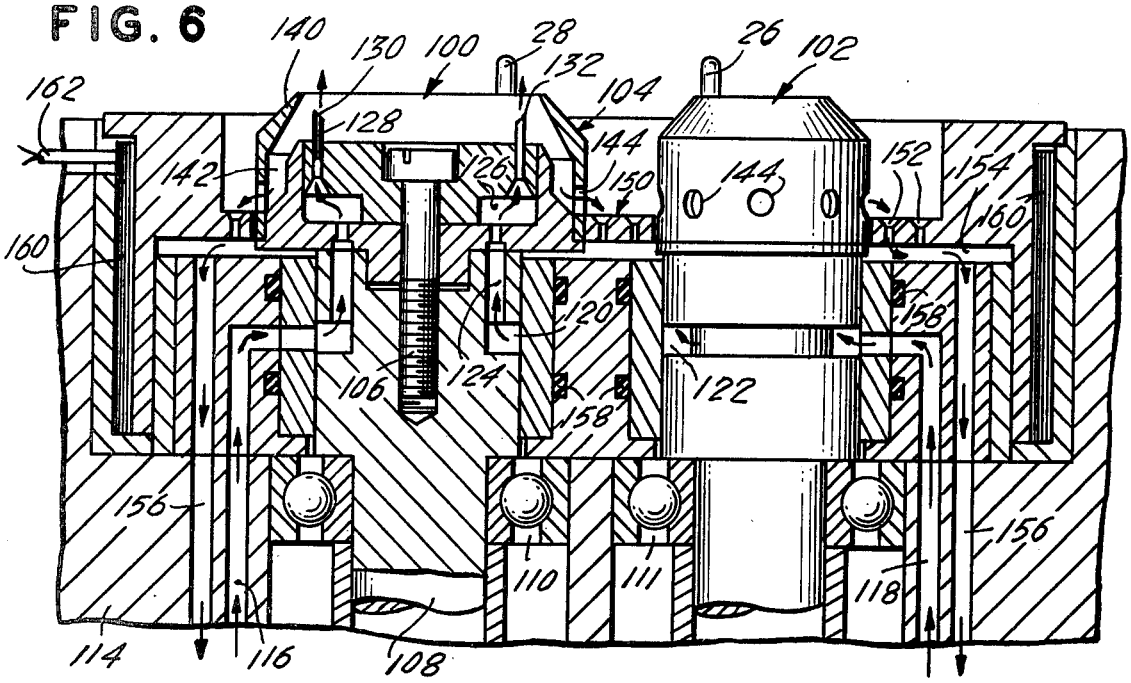
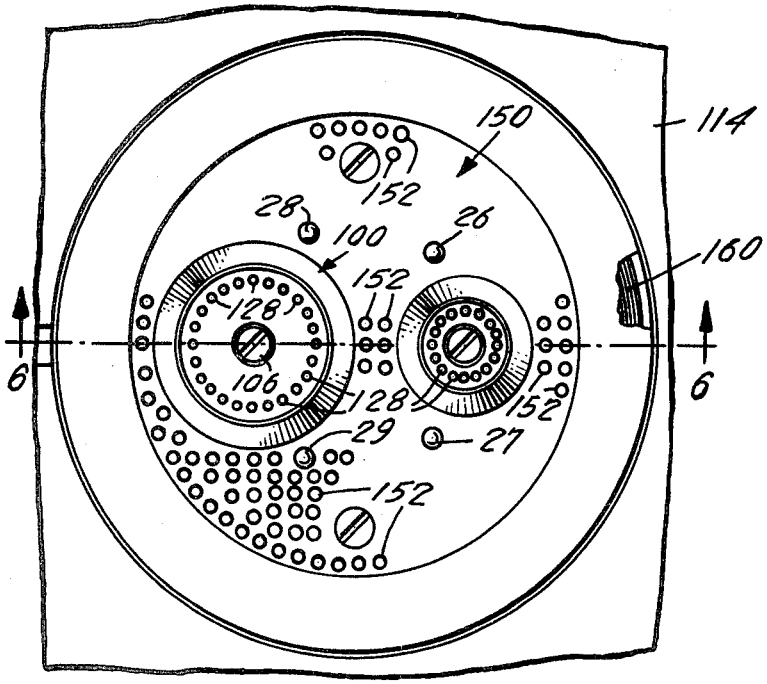
FIG. 5

DISPENSING NOZZLE FOR SEALING PLASTICS

BACKGROUND OF THE INVENTION

Typically the openings in a beer can end or a carbonated beverage can end include one large opening for dispensing the enclosed liquid and a smaller opening for allowing the entrance of atmospheric air. The openings are filled with metal buttons which are hinged to the can end. The inside periphery of the buttons needs to be sealed preferably with a plastics material such as plastisol.

U.S. Pat. No. 4,005,960 which issued Feb. 1, 1977 for an apparatus for applying plastics to planar surfaces is representative of the prior art. In that patent, a can end is positioned beneath a pair of dispensing nozzles which were aligned with the openings in the can end. The dispensing nozzles are sized and positioned to deliver a sealing plastics material, such as plastisol, downward onto and around the openings within the can end.

BRIEF DESCRIPTION OF THE INVENTION

Three embodiments of the invention are shown and described. In each of the embodiments, plastics material under pressure is delivered in controlled amounts and with precise timing. Each of the nozzles is sized and positioned immediately below the buttons in the can end. Each nozzle dispenses and sprays a substantially annular pattern of plastics sealant material around the button to seal the can end.

Each assembly of this invention comprises two separate rotating nozzles, each of which is supplied from a pressure source having predetermined pressure versus time characteristics.

The larger of the two nozzles is positioned immediately below the larger of the two can buttons, and the smaller nozzle is positioned immediately below the smaller can button. Both of the nozzles in a given set are identical in structure.

The nozzles rotate on bearings and are driven, for example, by an electric motor. Plastics adhesive is delivered to an annular groove around the periphery of the nozzle and thence through conduits within the spinning nozzle to the dispensing orifice or orifices.

The differences between the three described nozzle embodiments are primarily in the difference of the orifices. In a first embodiment, a single orifice is annularly shaped and positioned symmetrically relative to the spin axis of the nozzle. The periphery of the orifice is on a conical surface which typically has an apex angle between 90° and 135°. Preferably the apex angle is substantially 120°.

The second embodiment of the invention uses a circle of orifices with the center of the circle substantially at the center of the nozzle. The orifices are substantially parallel to the spin axis, but they intercept a conical surface, whose apex angle is typically between 90° and 135°, to facilitate dislodgement of the plastics material from the orifices.

In a third embodiment of the invention, a plurality of upstanding pipes, preferably made of surgical stainless steel, are typically configured in a circle around the periphery of the top of the nozzle to receive sealant plastics and to emit the plastics upward toward the adjacent button on the can end.

In the shown third embodiment, and it may also be used with the first and second embodiment, the pipes of each of the two nozzles are surrounded by a substantially circular shroud which effectively limits the throwing of the sealant.

Immediately adjacent the spinning nozzles is a substantially planar floor plate, for the nozzle, containing a plurality of small openings or holes leading into a plenum chamber which, in turn, is attached to a vacuum source to withdraw extra sealant and return it to a common reservoir. A heater is positioned around the nozzle assembly to keep the sealant soft and flowing.

It is therefore an object to this invention to deliver a circle of plastics sealant to the under side of a can end in the region of its buttoned openings and to have excess sealant returned to a common reservoir where it may be reused.

It is another object to this invention to provide a rotating nozzle for delivering plastics sealant to the under side of a predetermined region of a can's end to seal the buttoned can end closures.

BRIEF DESCRIPTION OF THE DRAWINGS

Other objects will become apparent from the following description, taken in connection with the accompanying drawings, in which:

FIG. 1 is a top view of a first embodiment of the invention;

FIG. 2 is a sectional view taken at 2—2 in FIG. 1;

FIG. 3 is a top view of the nozzle of the second embodiment of the invention;

FIG. 4 is a sectional taken at 4—4 in FIG. 3;

FIG. 5 is a top view of a preferred embodiment of the invention; and

FIG. 6 is a sectional view taken at 6—6 in FIG. 5.

DETAILED DESCRIPTION OF THE INVENTION

The apparatus of this invention is used to seal openings in the ends of carbonated beverage cans. Typically, the beverage can has large and small holes which are opened by pressing buttons downward with the fingers. The smaller buttoned hole is a vent, and the larger buttoned hole is a dispensing opening. Prior to opening, the buttons are sealed by a sealant of plastisol or equivalent.

To apply the sealant, the apparatus of this invention uses spinning nozzles which are positioned adjacent and beneath the buttoned openings. FIG. 2 shows a typical can end 10 having a button 12 in a large opening and a button 14 in a smaller opening. The buttons 12 and 14 are separated from the top 10 by cut scores, and they are hinged to the top 10 only at one point on each of their peripheries which is shown, for example, by the hinge member 16. The can end 10 in FIG. 2, sits on a shoulder 18, and it is held down by a ring 20 which is part of the can making apparatus (not shown). The end 10 is positioned adjacent the nozzles 22, 24 by the members 18 and 20, and after the adhesive is applied the member 20 removes the can end and places a new end into position.

An alternative supporting apparatus for the end 10 is a plurality of upstanding posts 26, 28, 27, 29 of FIGS. 5 and 6. The embodiment 18 or the embodiment 26 through 29 may be used to support the can end with any of the nozzles of this invention.

The nozzles 22 and 24 are supported by a housing 30. A pair of shafts 32 and 34, each having a vertical axis, are mounted relative to the housing 30 for rotation upon bearings 36 and 38, respectively. The shafts 32 and 34 each have an upper portion 33 and 35, respectively, with annular plenum chambers 37 and 39 formed therein by reducing the diameter of the upper portion 33, 35.

Conduits 40 and 42 connect to the plenum chambers 37 and 39 to deliver sealant to such plenum chambers. The sealant is measured and delivered under predetermined pressure by apparatus, usually piston apparatus (not shown).

The nozzles 22 and 24 are identical except that the nozzle 24 is smaller in diameter than the nozzle 22.

The nozzles 22 and 24 are attached, for example, by screw means 44 to the top portion of the shafts 33, 35, respectively. The nozzle 22 has an annular plenum chamber 46 near the top of the nozzle, connected by conduit 48 to the plenum chamber 37. An annular orifice 50 from the plenum chamber 46 is formed by a central member 52 which is screwed to the shaft 33 by the screw 44 and is substantially symmetrical about the axis of rotation of the shaft, whereby the annular orifice 50 is substantially symmetrical about the axis of the shaft. A peripheral member 54 is spaced apart from the member 52, in the region of the orifice 50, to create a uniform radial dimension to the orifice 50, as shown in FIG. 1. The top portion 55 of the peripheral member 54, above the orifice 50, is conically shaped so that sealant emitted from the annular orifice 50 is dislodged by the low adhesion of the relatively sharp edge 57.

Seals 58 are shown as O-ring seals, but they may be seals of other appropriate types.

The shafts 32 and 34 are independently driven and spun on the bearings 36 and 38 by motor means (not shown).

A second embodiment of the nozzle of the invention is shown in FIGS. 3 and 4. The nozzles may be of different sizes, and usually are of different sizes due to the fact that the buttons in the can end are of different sizes.

The main difference between the nozzle of FIGS. 3 and 4 and the nozzle of FIGS. 1 and 2 is that, instead of the annular orifice 50, a plurality of axially directed orifices 60 are formed in a circle about the axis of rotation and penetrating the conical surface 62 which corresponds to the surface 55 of FIG. 2. The orifices 60 appear circular in FIG. 3, but the intersection of the circular orifice with a conical surface is slightly non-circular in shape so that the sealant material emitted from the orifices 60 is dislodged at the points 64 and at the edge of the conical surface 66.

Sealant is delivered through conduits 68 and 70 in a fashion similar to the delivery of sealant in FIGS. 1 and 2. Sealant from conduits 68 and 70 is delivered to a plenum chamber 72 and thence through conduits 74 to the orifices 60.

The embodiment shown in FIGS. 5 and 6 is the preferred embodiment of the invention. The spinning nozzles 100 and 102 are sized and positioned to be directly under particular buttons in the can end 10 as shown in FIG. 2. The can end, however, is positioned by the upright members 26 through 29 as shown in FIGS. 5 and 6, and by a holding member 20 as shown in FIG. 2.

The spinning members 100 and 102 have a nozzle member 104 which is attached by screw means 106, substantially on the spin axis thereof, to a shaft 108 which is mounted upon bearings 110 and 111 relative to the housing 114. A predetermined quantity of sealant under a predetermined pressure is delivered to the conduit 116 and 118 for further delivery to the plenum chambers 120 and 122. The plenum chambers 120 and 122 are similar to the plenum chambers 37 and 39 in FIG. 2.

Sealant is delivered from chambers 120 and 122 through axially directed conduits such as conduits 124 into an annular plenum chamber 126 on the nozzle head 104.

Upstanding from the chamber 126 are a plurality of tubular members 128 which are preferably of surgical steel and similar to the tube of a hypodermic needle. The end 130 of each of the up-standing tubes 128 is beveled, and it has an outward tip 132 which facilitates dislodging of the sealant material which is extruded through the center of the tube 128 and the orifice in the surface 130.

Surrounding the circle of upstanding tubular members 128 is a shroud 140 which deflects superfluous sealant downward into the plenum 142 from whence it may drain through the circle of holes 144 onto the substantially horizontal planar surface 150 which is shown more particularly in FIG. 5.

The planar surface 150 has a plurality of downwardly extending orifices 152 which open into a plenum 154. The plenum 154 is attached to vacuum discharge lines 156 which draw excess sealant back into a common reservoir (not shown).

Seals such as O-ring seals 158 may be used where necessary.

The region containing excess sealant is heated by an electric heater 160 which receives its electrical energy source through a cord 162. The heating of adhesive in the region of orifices 152, plenum 154, and vacuum discharge lines 156 is desirable to keep the sealant soft and flowing.

Notice again that the orifice 50 of FIGS. 1 and 2, the orifices 60 of FIGS. 3 and 4, and the surfaces 130 of FIGS. 5 and 6, are all cut on a beveled surface whose apex angle may be set between, for example, 90° and 135°, with a preferred angle about 120°.

In operation, the nozzles are spinning, the can end 10 is placed in position, and charges of sealant are delivered through the nozzles. The sealant amount and pressure is predetermined and delivered at a timed moment when the buttons 12 and 14 are immediately over the nozzles and in position to receive the sealing material. The shafts are spinning. Vacuum, if desired, is applied to remove the excess adhesive, and the heating element 160 is operating to keep the returning sealant soft and flowing.

Referring to FIGS. 1 and 2, sealant is delivered from conduit 40 into plenum 37 thence through conduit 48 into plenum 46 and upward through the orifice 50 where the rotating nozzle 22 throws the sealant against the edges of the button 12, sealing the button to the remainder of the can top. As the sealant material is thrown off by the spinning nozzle, the last contact of the material reaches the edge 57, and the adhering force is minimal on that edge whereby all of the sealant material is thrown off, and most of the sealant material is thrown against the can end 10 in the desired region around the button margins.

In the embodiment of FIGS. 3 and 4, the sealant material is delivered through conduits 70 to the orifices 60, and because the orifices 60 are penetrating a conical surface, the last contact with the orifice is on one side only, i.e. the upper radially outward side of each orifice, whereby the sealant becomes easily dislodged to clear the orifices 60. Further travel of the sealant up the conical surface 62 causes it to reach the edge 66 which also has a very low contact area with the sealant, and the sealant reliably breaks free.

Similarly, the beveled surfaces 130, at the ends of the tubular members 128, are deliberate so that the sealant material is thrown off of the tube 128 at the tip 132 which has a very small area and very little adherence to the adhesive material.

The shroud 140 prevents the material from being thrown excessively, and the vacuum applied through conduit 156 to plenum 154 through the orifices 152 pulls or sucks the excessive adhesive into a common reservior (not shown). The heater 160 keeps the returning sealant soft and flowing.

Although the invention has been described in detail above, it is not intended that the invention shall be limited by that description but only in accordance with the spirit and scope of the claims read in view of the specification.

We claim:

1. A nozzle assembly incorporated in can end making apparatus for dispensing sealant plastics to the underside of can ends comprising in combination:

(a) a housing;

(b) a rotatable shaft, received within said housing, having a substantially vertical spin axis, and including an annular plenum chamber for receiving said sealant plastics;

(c) a nozzle head attached to the top end of said shaft to rotate with said shaft within said housing, said nozzle head including orifice means comprising a ring of upstanding substantially vertical, thin walled tubes said ring being substantially centered on the axis of said shaft, with the upper end of each of said tubes being sharply beveled to exposed the the tubing bore thereby forming a radially outwardly disposed tip to facilitate the dislodging of said sealant plastics extruded therefrom;

(d) first conduit means for delivering said sealant plastics into said plenum chamber on said shaft; and (e) second conduit means for delivering said sealant plastics from said plenum chamber to said orifice means.

2. A nozzle assembly as recited in claim 1 wherein the upper ends of said upstanding tubes are beveled to form an apex angle of 120°.

3. A nozzle assembly as recited in claim 1 further comprising:

(a) a horizontal planar member mounted in said housing, adapted to receive for rotation said nozzle head and containing a field of vacuum applying holes disposed around said nozzle head;

(b) a shroud encircling said ring of tubes to form a peripheral wall on said nozzle head to deflect and capture superfluous sealant which may be thrown from said tubes during rotation, and having drain holes at the base thereof to permit said superfluous sealant to drain onto said horizontal planar member for discharge through said vacuum holes; and (c) a heater mounted in said housing to keep said superfluous sealant warm and flowing thereby facilitating drainage through said vacuum holes.

* * * * *